US005417416A

United States Patent [19]

Marmin et al.

[11] Patent Number: 5,417,416

[45] Date of Patent: May 23, 1995

[54] APPARATUS FOR SLOWING DOWN SIGNATURES SENT TO A QUARTER FOLD OF A FOLDER FOR A PRINTING MACHINE

[75] Inventors: Jean-Claude Marmin, Estrees; Marie-Helene Pierre, Clermont; Andre Reponty, Gouvieux, all of France

[73] Assignee: Heidelberger Druckmaschinen AG, Heidelberg, Germany

[21] Appl. No.: 832,924

[22] Filed: Feb. 10, 1992

[30] Foreign Application Priority Data

Feb. 8, 1991 [FR] France ..... 91 01476

[51] Int. Cl.[6] ..... B65H 5/34

[52] U.S. Cl. ..... 271/270; 271/273; 271/182; 271/202; 74/393

[58] Field of Search ..... 271/182, 183, 202, 203, 271/270, 272, 273, 314, 275; 198/461, 462, 624; 464/136; 74/393

[56] References Cited

U.S. PATENT DOCUMENTS

| | | | |
|---|---|---|---|
| 2,580,469 | 1/1952 | Schwartz | 271/225 X |
| 3,287,984 | 11/1966 | Neubauer | 74/393 X |
| 3,507,489 | 4/1970 | Wilshin et al. | 271/182 |
| 3,685,823 | 8/1972 | Chambon | 271/182 |
| 3,830,355 | 8/1974 | Verjux | 271/270 X |
| 3,861,515 | 1/1975 | Runyan et al. | 271/182 X |
| 4,279,410 | 7/1981 | Bolza-Schunemann | 270/6 |
| 4,436,302 | 3/1984 | Frye et al. | 271/202 |
| 4,548,404 | 10/1985 | Brandt et al. | 271/303 |
| 4,775,136 | 10/1988 | Peterson | 270/54 |
| 4,807,865 | 2/1989 | Kobler et al. | 270/54 |
| 4,925,173 | 5/1990 | Lindblom et al. | 270/54 |
| 4,995,859 | 2/1991 | Totani | 271/182 X |
| 5,039,082 | 8/1991 | Littleton | 271/202 X |
| 5,265,861 | 11/1993 | Schaffner et al. | 271/182 |

FOREIGN PATENT DOCUMENTS

| | | | |
|---|---|---|---|
| 2114865 | 10/1972 | Germany | B65H 29/68 |
| 2141340 | 2/1973 | Germany | 271/202 |
| 2757448A1 | 7/1978 | Germany | B65H 35/08 |
| 3409548A1 | 10/1984 | Germany | B65H 29/68 |
| 3938535 | 6/1990 | Germany | 271/182 |
| 3940960 | 7/1991 | Germany . | |
| 57-145763A | 9/1982 | Japan | B65H 29/68 |
| 1499104 | 1/1978 | United Kingdom | 271/182 |
| 1593493 | 7/1981 | United Kingdom | B65H 29/68 |

*Primary Examiner*—Robert P. Olszewski
*Assistant Examiner*—Boris Milef
*Attorney, Agent, or Firm*—Kenyon & Kenyon

[57] ABSTRACT

An apparatus and method for slowing down signatures sent to a quarter fold of a folder for a printing machine are disclosed. Signatures are transported between a first set of fast belts including upper belts and lower belts. The signatures are then received at their leading edge by an assembly of upper and lower partial pulleys mounted to a frame which changes the speed of the signatures to a slow speed. The signatures are then received at their leading edge by a second set of slow belts including upper belts and lower belts.

7 Claims, 12 Drawing Sheets

APPARATUS FOR SLOWING DOWN SIGNATURES SENT TO A QUARTER FOLD OF A FOLDER FOR A PRINTING MACHINE

FIELD OF THE INVENTION

The present invention relates to a folder, in which signatures are transported by transport means, pulleys, and belts.

BACKGROUND INFORMATION

During the printing process, signatures, e.g., folded printed sheets for forming sections of a book, pamphlet, newspaper, etc., initially transported at high speed in a folder machine for folding a continuous web of printed paper, must be slowed down for subsequent processing in order to prevent blockages from occurring during folding, especially when a quarter fold is to be made.

For example, brush systems and vacuum devices which exercise a speed reducing force on a signature are well known and serve to reduce signature speed.

Slow-down cylinders have also been used to reduce the speed of a signature. Typically, two cylinders are placed in series, leading the signature to the quarter fold, and each of them produces a speed reduction of 30%. This method, however, is complex and thus expensive.

Sets of belts which operate from high speed to low speed are also known. Signatures are transported from high-speed belts to low-speed belts which receive them. This method, however, causes a sudden change in the speed of a signature, with no gradual transition, and thus the signature is often transferred without precision in a partly uncontrolled manner which leads to inaccuracy and blockages.

One advantage of the present invention is that the signatures are gradually slowed down by an assembly of partial pulleys prior to folding. This minimizes blockages and other inaccuracies which occur when the signatures are suddenly slowed down.

Another advantage of the present invention is that the signatures are continuously supported and conveyed throughout their travel. Thus, blockages and other inaccuracies are further minimized.

OBJECTS AND SUMMARY OF THE INVENTION

It is an object of the present invention to provide a simple and economical apparatus and method for reducing the speed of signatures being transported through a folder machine, that are precise and less subject to blockage and other problems associated with the prior art.

The present invention provides an apparatus for changing the speed of signatures being transported through a folder machine comprising: a first transport means for transporting a signature; an assembly of upper and lower partial pulleys mounted to a frame adapted to receive the signature by its leading edge from the first transport means at a first speed and change the first speed to a second speed; and a second transport means adapted to receive the signature by its leading edge from the assembly of upper and lower partial pulleys at the second speed.

The present invention also provides a method for changing the speed of signatures being transported in a folder machine comprising the steps of: transporting a signature from a first transport means to an assembly of upper and lower partial pulleys mounted to a frame; changing the speed of the signature from a first speed to a second speed as the signature is received by its leading edge from the first transport means and transported through the assembly of upper and lower partial pulleys; and transporting the signature to a second transport means adapted to receive the signature from the assembly of upper and lower partial pulleys at the second speed, Other characteristics and advantages of the invention will be made apparent in the light of the following detailed description and accompanying drawings.

DETAILED DESCRIPTION

Figure 1:
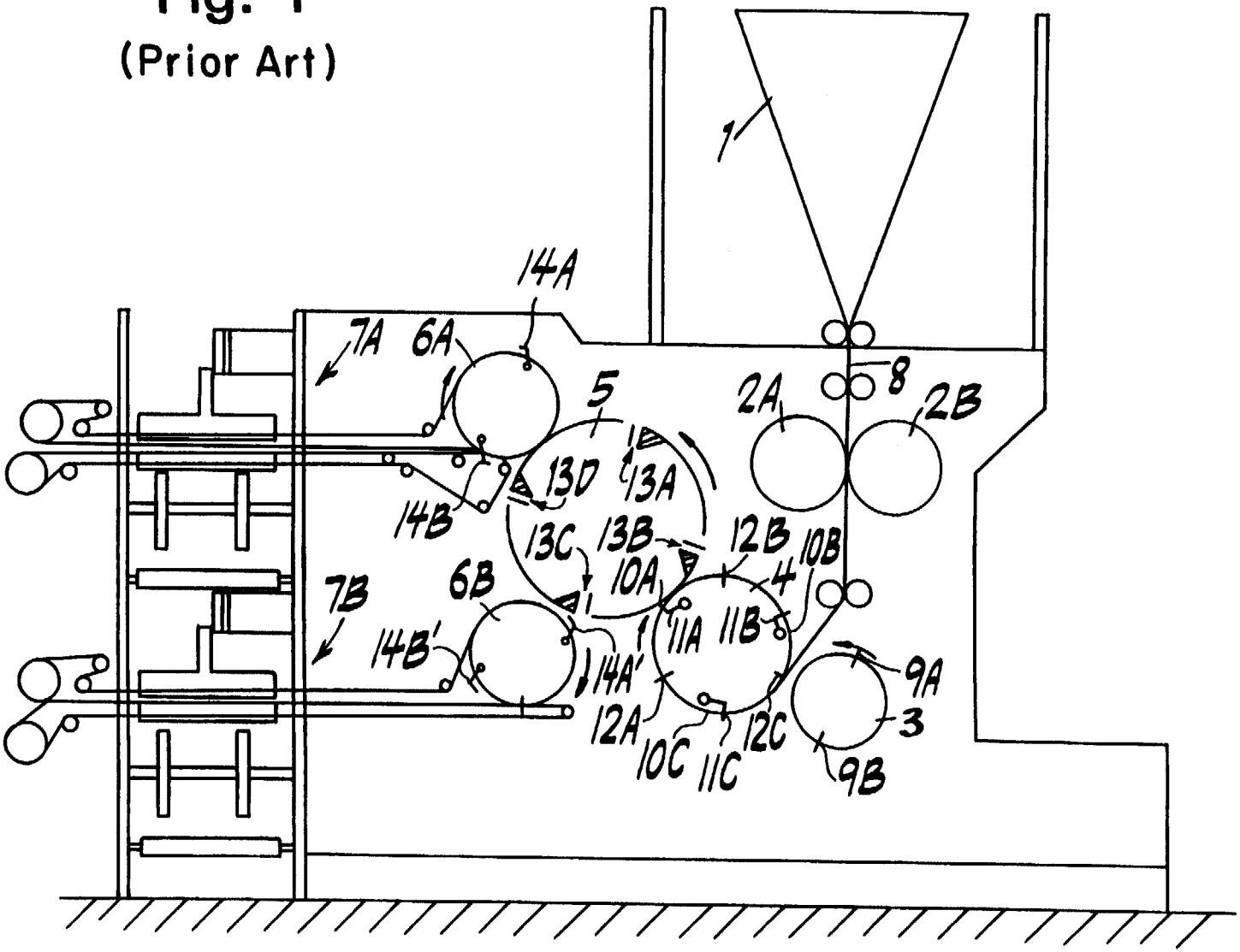
Fig. 1 (Prior Art)
FIG. 1 is a side plan view of a known folder (Prior Art).

A typical folding machine, as shown in FIG. 1, comprises a triangular former 1 over which a web of printed paper slides, forming a longitudinal fold, parallel to the two edges of the paper, the two half-widths overlapping each other. The web 8, thus folded in two, passes between various sets of rollers for completing the fold, and through a pair of perforating cylinders 2A and 2B which perforate the web 8 at a future position of a second fold.

The folded and perforated web 8 then passes between a cutting cylinder 3 and a collect or transfer cylinder 4. The cutting cylinder 3 has saws 9A and 9B extending from its surface facing web 8 for forming generator lines which cooperate with cutting rubber 10A, 10B and 10C on transfer cylinder 4 and thus cut the folded web 8. Impaling pins 11A, 11B and 11C on transfer cylinder 4 are placed near the leading edge of the signature thus cut in order to support it on transfer cylinder 4 for further processing. Tucking blades 12A, 12B and 12C on transfer cylinder 4 insert the middle of the signature into jaws 13A, 13B, 13C and 13D on a folding cylinder 5. As the cylinders rotate in the directions indicated by the arrows, as shown in FIG. 1, the signatures are folded and gripped in the jaws 13A-D.

Slow-down cylinders 6A and 6B grasp successive signatures alternately from the folding cylinder 5. These slow-down cylinders 6A and 6B are provided with grippers, 14A and 14B for 6A, and 14A' and 14B' for 6B. These cylinders are called "slow-down" cylinders because they turn at the same angular velocity as the folding cylinder 5 from which they receive a cut and folded signature but they are of smaller diameter than folding cylinder 5 and consequently they have a lower linear velocity.

The system is set so that the gripper 14B for slow-down cylinder 6A grasps a signature which is in the jaw 13D on folding cylinder 5 and the gripper 14A grasps the signature in jaw 13B. Similarly, the gripper 14A' for slow-down cylinder 6B grasps the signature in jaw 13C on folding cylinder 5, and gripper 14B' grasps the signature in jaw 13A. At the outlet of the slow-down cylinders 6A and 6B, parallel belts take the signature, which has been folded, and direct it towards a device 7A corresponding to cylinder 6A, or 7B corresponding to cylinder 6B. These devices 7A and 7B, shown in FIGS. 2-4, are called "quarter folds" and how they operate will be explained below.

Figure 2:
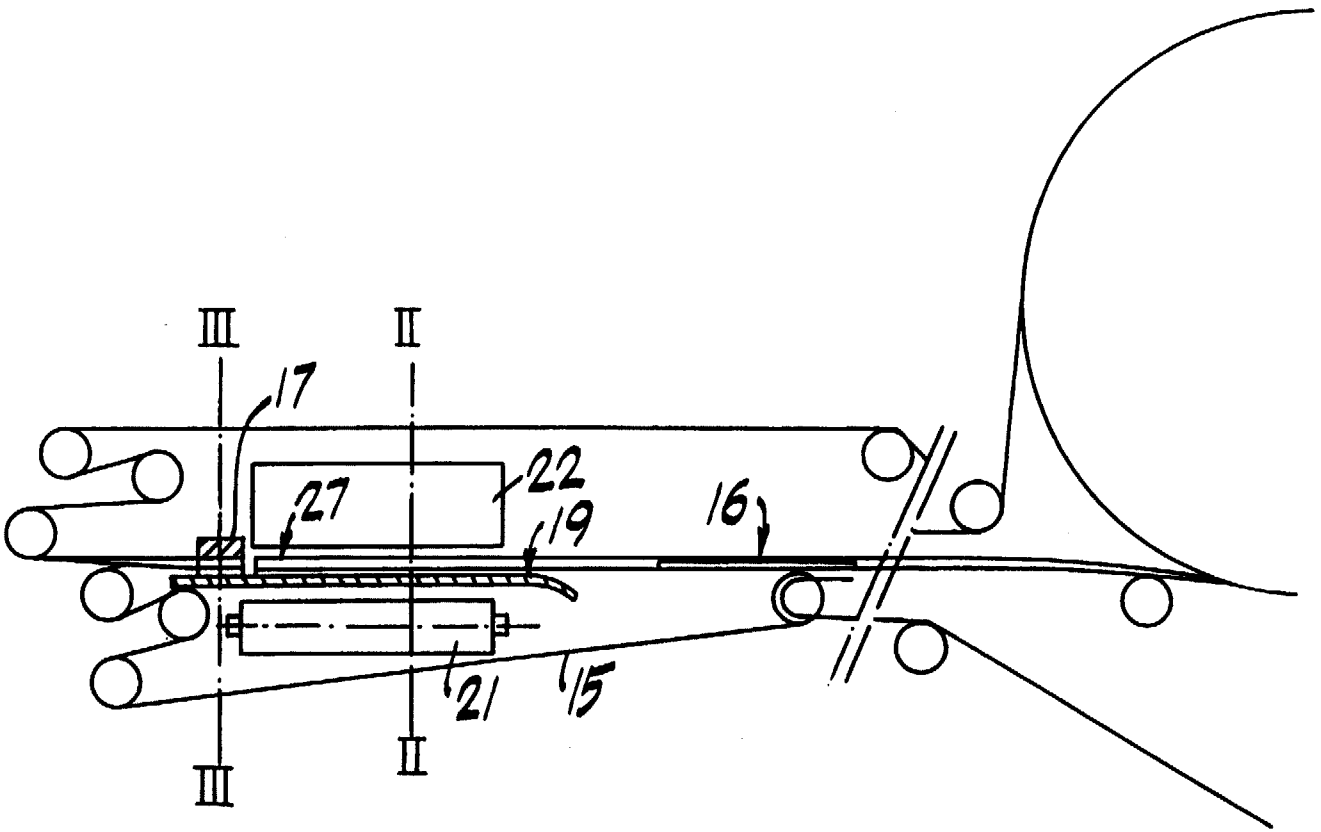
Fig. 2 (Prior Art)
FIG. 2 is side plan view of a quarter fold device of the assembly of FIG. 1 (Prior Art).

A group of four belts 15 are situated below the signature for receiving the signature as it issues from the slow-down cylinder 6A or 6B, as shown in FIG. 2. A second group of belts 16 situated above the signature removes the signature from the slow-down cylinder 6A or 6B and transports it until it comes into contact with the headstop 17, where it stops, sliding between the belts. The headstop 17 is in the form of a comb, its base having four notches 18 through which the belts 15 and 16 pass, as shown in FIG. 4. A fold table 19, with a central slit 20, is placed below the belts 15 and 16 which rest upon the table. Two folder rollers 21A and 21B, turning in opposite directions, as shown in FIG. 3, are placed below the table 19, facing the slit 20.

Figure 3:
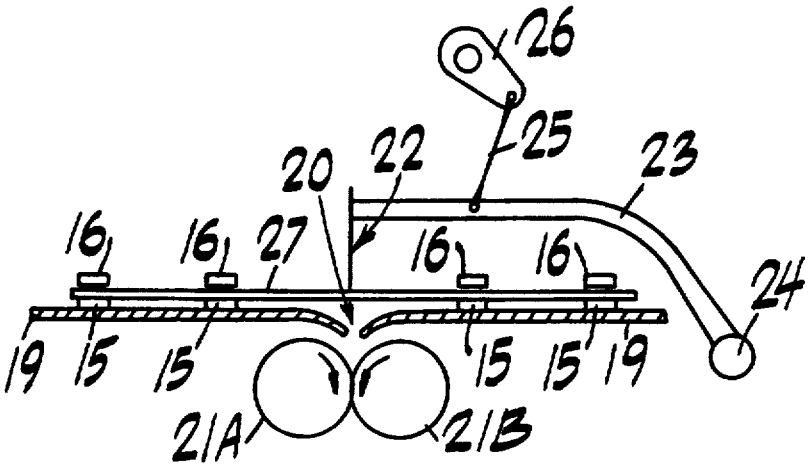
Fig. 3 (Prior Art)
FIG. 3 is a cross-sectional view of plane II of FIG. 2 (Prior Art).
Figure 4:
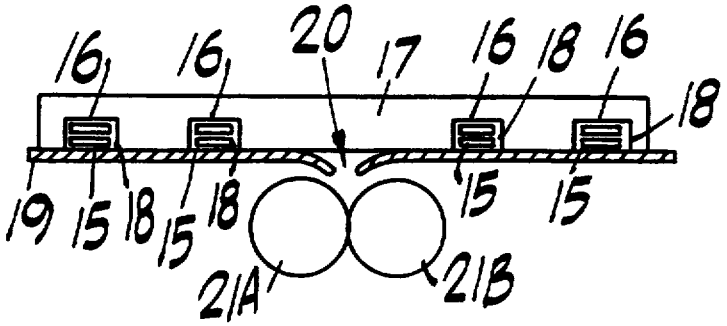
Fig. 4 (Prior Art)
FIG. 4 is a cross-sectional view of plane III of FIG. 2 (Prior Art).

A knife 22, fixed to the end of an arm 23, itself hinged about an axis 24, is reciprocated by means of a rod 25 and crank 26, as shown in FIG. 3. The drive system as a whole is organized in such a way that the blade or knife 22 is in the low position just after a signature 27 arrives at the headstop 17. The folder rollers 21A and 21B then grasp the signature and fold it perpendicularly to the fold made between cylinders 4 and 5. This is called the "quarter" fold. This entire device, the drive system of such a machine, and its various settings are well known to those skilled in the art and are not described further.

Figure 5:
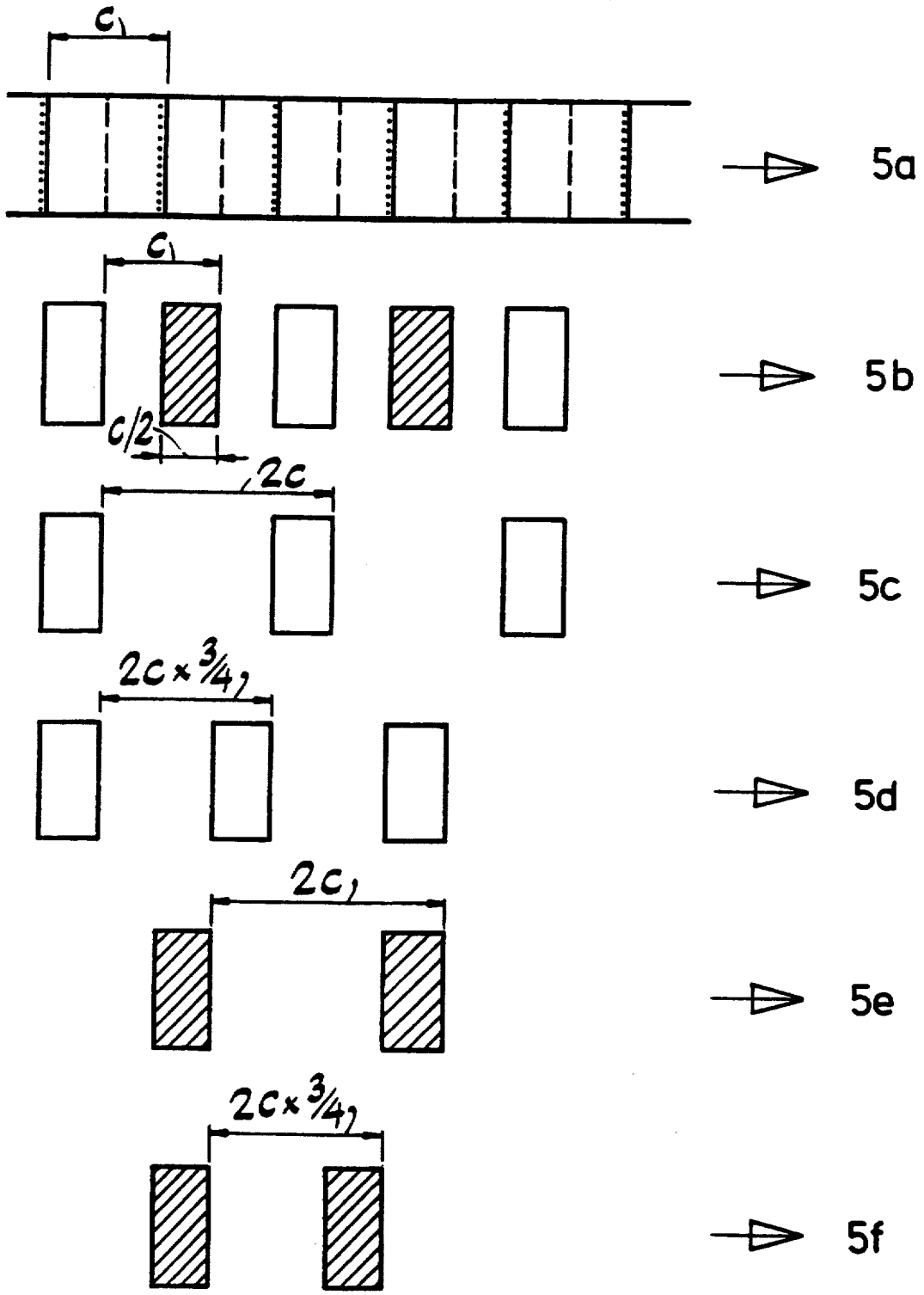
Fig. 5 (Prior Art)
FIG. 5,*a–f* is a series of diagrams showing how signatures are distributed in the folder assembly of FIG. 1 (Prior Art).

Signatures are distributed in a folder of this type as shown in FIGS. 5*a*-*f*. FIG. 5*a* shows the web of paper it is presented to the transfer cylinder 4: perforated and cut, but not folded. The length of each signature at this point is equal to C. The pitch, i.e., the distance between the leading edges (or trailing edges) of successive signatures, is also equal to C. FIG. 5*b* shows the signatures on the folding cylinder 5 after being folded. The pitch is still C, but the length of each signature is C/2 since the signature has been folded in two. FIG. 5*c* shows only those signatures which have been directed to slow-down cylinder 6A, before being slowed down. Since only alternate signatures are sent to slow-down cylinder 6A a gap of length C is created between the leading edges of successive signatures. The pitch thus becomes 2C. However, the length of the signatures at this point remains C/2. FIG. 5*d* shows those signatures sent to slow-down cylinder 6A, after being slowed down 25%. The pitch between these signatures is reduced 25% and thus becomes 6C/4 (¾ of 2C). The length of the signatures remains C/2. FIGS. 5*e* and 5*f* show the pitch and length of the signatures of FIG. 5*b* that are sent to slow-down cylinder 6B. The process is entirely identical to that of the slow-down cylinder 6A.

It should be noted that in a quarter folding system, sufficient space must remain between two successive signatures. In fact, since the folding process is discontinuous, and the signature which is being folded stops on the head stop 17, there is a risk that the following signature may interfere with the signature being folded, as it advances between the two sets of belts. To avoid such interference, for usual quarter folds and where the length of a signature is C/2, the pitch between two successive signatures must be equal to not less than C. This means that quarter folding systems must not slow down by more than 50%. It is very difficult to achieve such slowing with only one slow-down cylinder.

Figure 6:
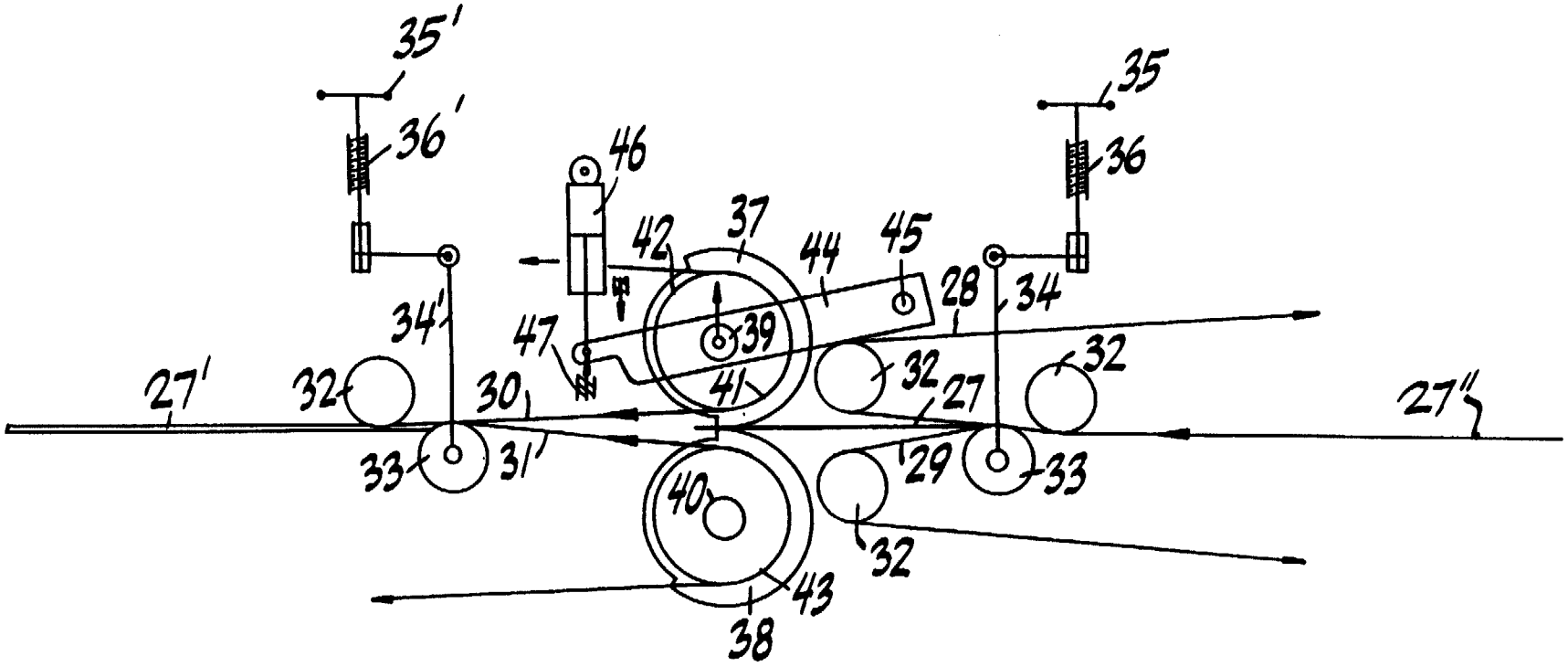
FIG. 6 is a side plan view of an apparatus embodying the present invention.

FIG. 6 shows a succession of signatures, 27, 27' and 27'', as they are transported through an apparatus embodying the present invention. Signature 27 is being transported by a first transport means which is preferably two sets of belts: upper fast belts 28 and lower fast belts 29 which are wound around slow-down cylinders 6A or 6B and have a surface speed equal to that of these cylinders. Signature 27' is being gripped at its leading edge by an assembly of partial pulleys: upper partial pulleys 37 and lower partial pulleys 38, as it is being released at its trailing edge by the upper fast belts 28 and the lower fast belts 29. Partial pulleys 37 and 38 are keyed respectively to shafts 39 and 40. Each of these pulleys has a part of its circumference (including a peripheral notch) covered with rubber, and as a result, these pulleys are referred to as "partial pulleys". The signature 27'' is being transported by a second transport means which is preferably two sets of slow belts: upper slow belts 30 and lower slow belts 31, turning at half the speed of the machine, and leading the signature 27'' to the quarter fold headstop 17. These four sets of belts roll around a number of return rollers 32.

The speeds of the first and second transport means and the assembly of partial pulleys can preferably be adjusted.

Furthermore, a device consisting of a roller 33 mounted to oscillate at the end of a lever 34 whose longitudinal position is adjusted by adjusting wheel 35 acting on a nut and bolt system 36, serves to adjust the position at which signature gripping between the fast belts 28 and 29 ends. An entirely identical system serves to adjust the position at which signature gripping between the slow belts 30 and 31 begins. This system bears the references 33', 34', 35', and 36'.

Figure 7:
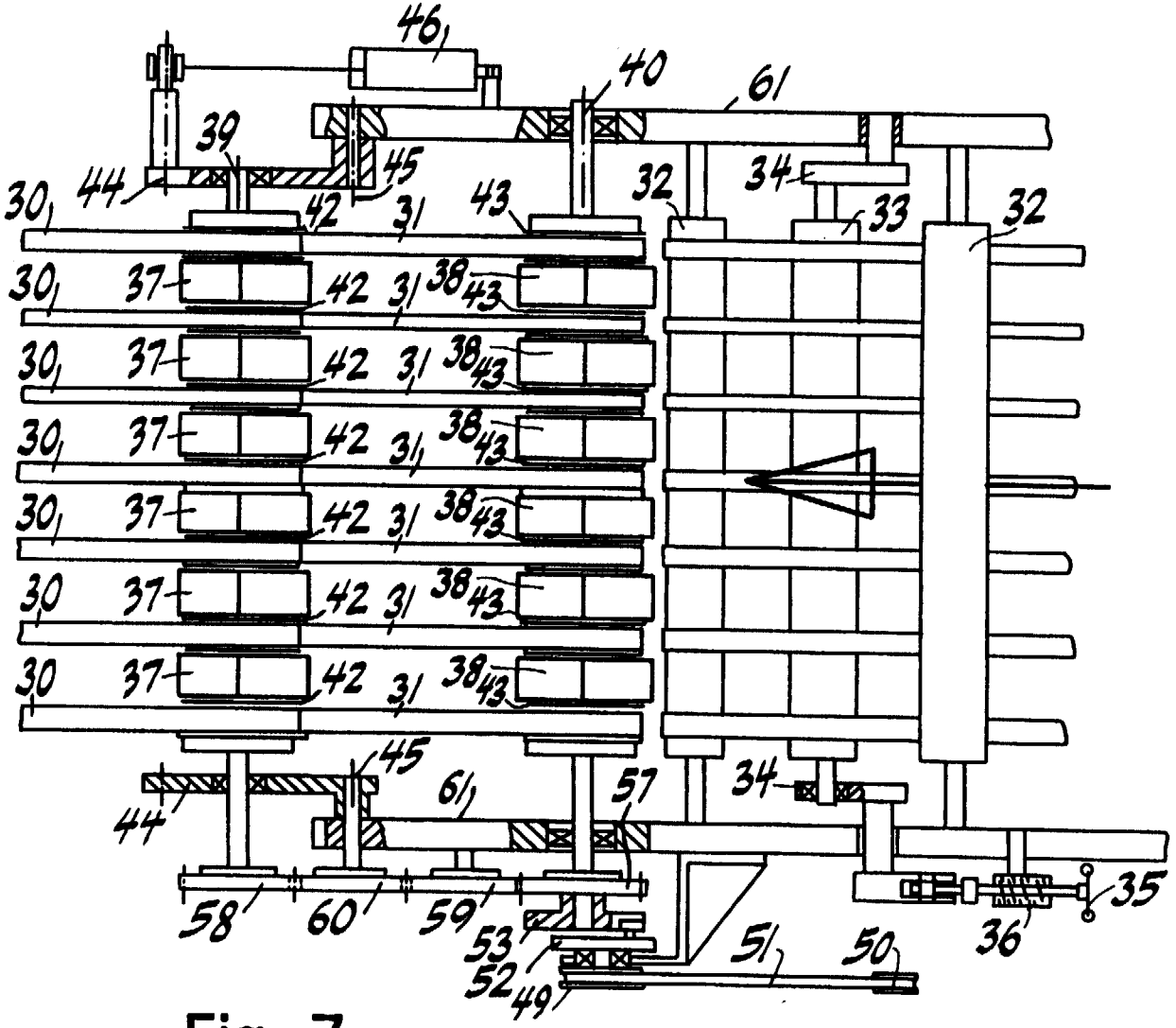
FIG. 7 is a partial top plan view of the apparatus shown in FIG. 6.

The lower slow belts 31 wind around return pulleys 43 which are of smaller diameter than the partial pulleys 38 and which are mounted to rotate freely on shaft 40, as shown in FIG. 7. Similarly, the upper slow belts 30 wind around return pulleys 42 mounted to rotate freely on shaft 39 between the partial pulleys 37.

The assembly of upper and lower partial pulleys is mounted to a frame 61. The shaft 40 keyed to the lower partial pulleys 38 is mounted to rotate on the frame 61, as shown in FIG. 7. The shaft 39 is mounted to rotate on two levers 44 and 44' which are respectively hinged to the frame 61 about an axis 45, also shown in FIG. 7. The assembly is held in position by a spring means which is preferably a pneumatic actuator 46 urging the lever 44 against an adjustable stop 47 which is fixed to the frame 61, as shown in FIG. 6. This allows the shafts 39 and 40 to be maintained in fixed positions and at a constant distance apart.

Figure 8A:
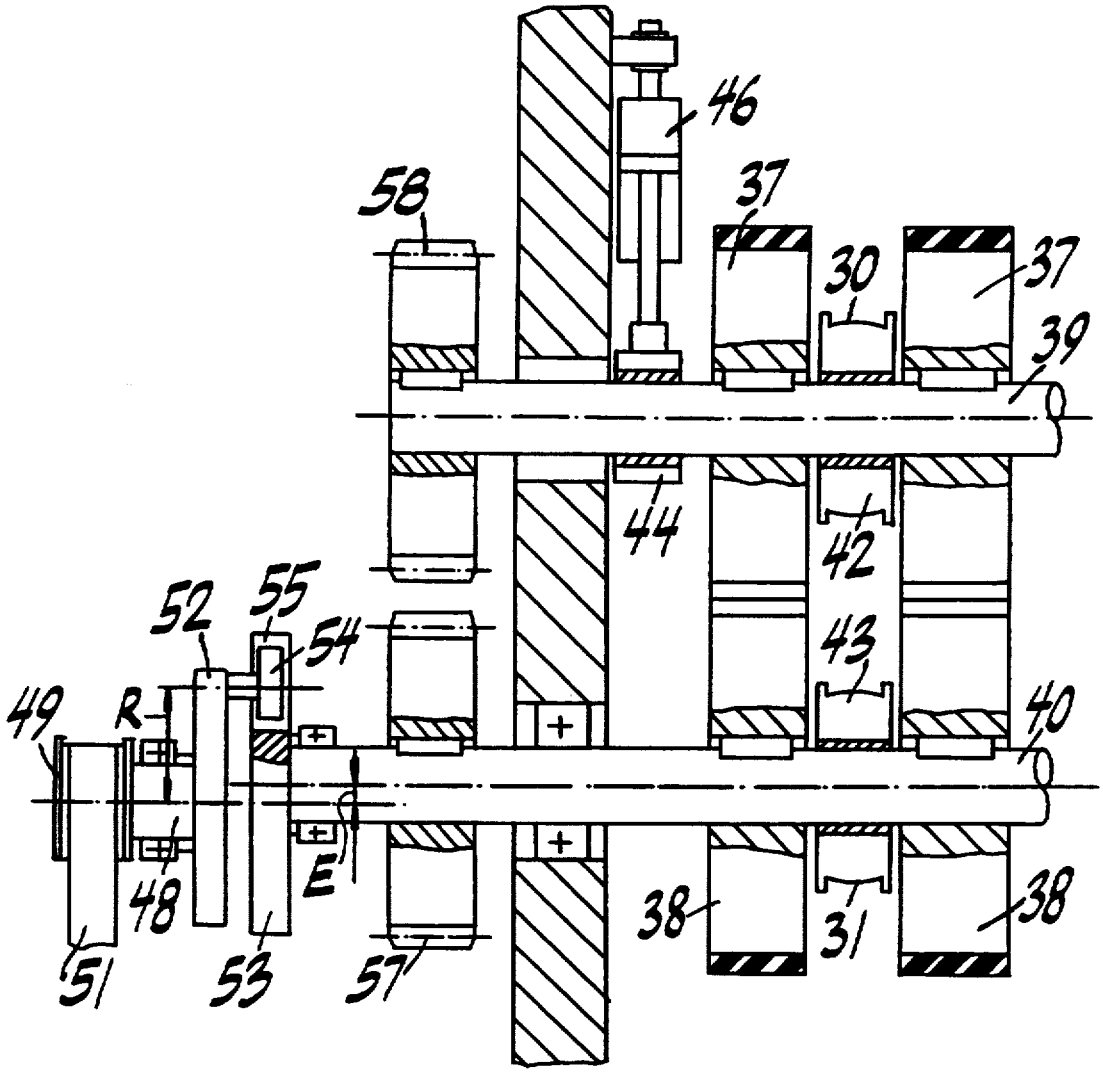
FIGS. 8*a* and *b* are cross-sectional and side plan views respectively of one embodiment of the assembly for providing drive at cyclically variable speed of the present invention.
Figure 8B:
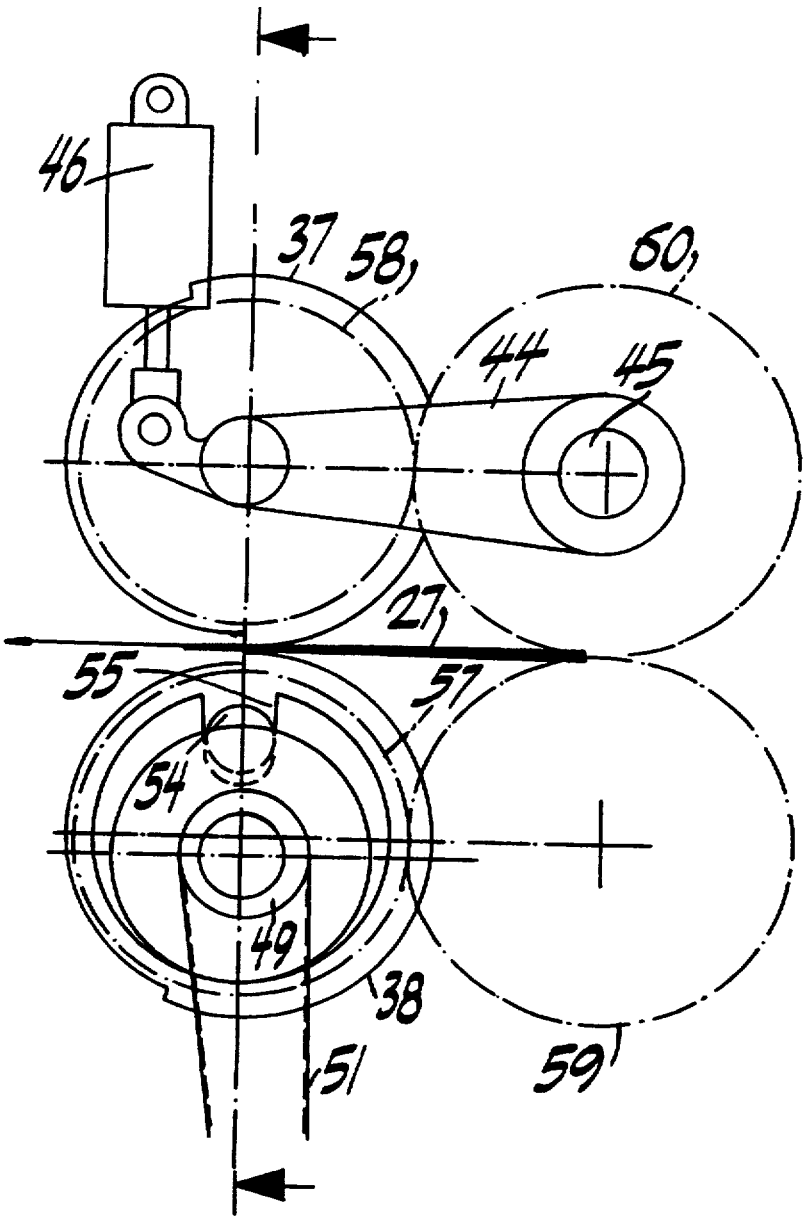
FIG. 8*c* is a cross-sectional view of another embodiment of the assembly for providing drive at cyclically variable speed of the present invention.

The preferred assembly for providing drive at cyclically variable speed is shown in FIGS. 8*a* and *b*. This assembly is composed of the following components: an intermediate inlet shaft 48 driven from the general control of the machine by a pulley 49 and a cog belt 51. This assembly is linked in such a way that a flange 52 mounted at the end of the shaft 48 makes one full turn each time the folder delivers a signature 27'. The flange 52 drives a facing flange 53 by means of a cam wheel 54 fixed on the flange 52 and sliding in a notch 55 formed in the flange 53, as shown in FIG. 8*a*. This flange 53 is itself integral with the driven shaft 40 which has a gear 57 keyed thereto and which also drives the lower partial pulleys 38. The gear 57 is linked to a gear 58 via two intermediate gear wheels 59 and 60, as shown in FIG. 8*b*. The gear 58 has the same diameter as the gear 57 and is keyed to the shaft 39, as shown in FIG. 8*a*. The gear 58 itself drives the upper partial pulleys 37.

This system ensures that the upper and lower partial pulleys 37 and 38 are driven synchronously, while allowing the pressure between these pulleys to be adjusted. The upper and lower partial pulleys 37 and 38 are positioned so that their rubber-covered parts, and thus their parts of greater diameter, are exactly in phase, i.e., the beginnings and the ends of the rubber pass the center lines of shafts 39 and 40 at the same time at the top and at the bottom, thus simultaneously gripping or freeing a signature 27' inserted between them.

If R is the radius of rotation of the axis of the cam wheel 54 about the shaft 48, and E is the eccentricity between the shafts 40 and 48, then once per revolution the speed of the shaft 40 will reach a maximum equal to $V*R/(R-E)$ and a minimum equal to $V*R/(R+E)$, where V is the angular inlet speed of the shaft 48.

Figure 9:
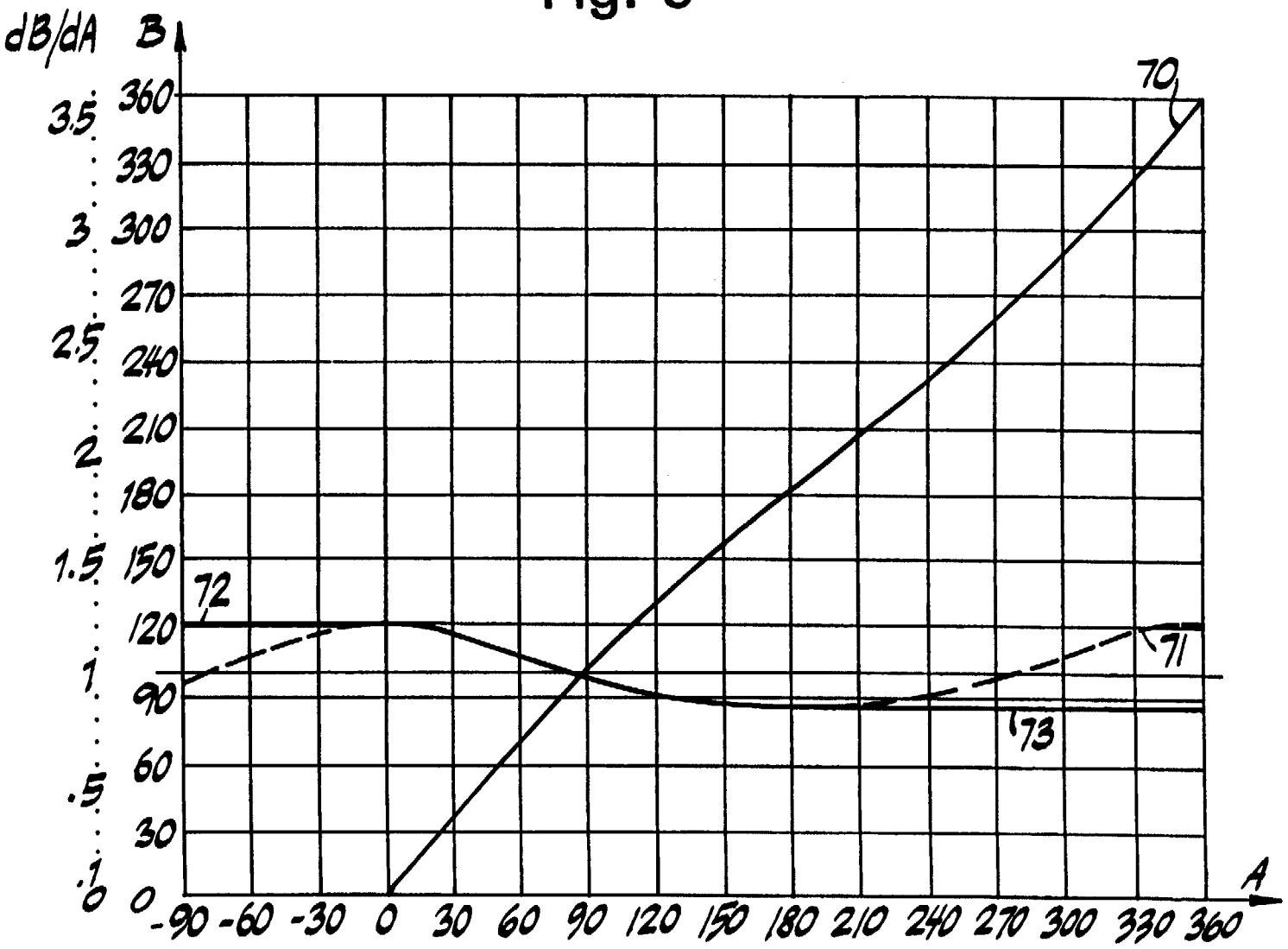
FIG. 9 is a graph of the angles of rotation of the inlet and outlet shafts of the assembly of FIGS. 8*a* and *b* and the ratio of their angular speeds.

In FIG. 9, the angle of rotation A of the inlet shaft 48 of the device of FIGS. 8*a* and *b* is plotted along the X-axis from −90° to +360°. The angle of rotation B of the outlet shaft 40 is plotted along the Y-axis from 0° to +360°. The curve 70 represents the relationship of the outlet angle as a function of the inlet angle. The curve 71, shown on the same graph and drawn partly as a dotted line and partly as a solid line, is the derivative of curve 70 and shows at all points the ratio of the angular outlet speed to the angular inlet speed in the device of FIGS. 8*a* and *b*. Thus, the curve 71 shows the variation in the surface speed of the partial pulleys 37 and 38 as a function of their angular positions.

The device used in the above description for obtaining cyclic speed variation (crank driving a notched flange) could be replaced by any other type of device, for example:

by an indexer-type device;

a cardan joint with the following proportions can also be used:

maximum speed = inlet speed / cos$\alpha$ minimum speed = inlet speed * cos$\alpha$ The outlet speed of a single cardan joint forming an angle $\alpha$ between an inlet shaft 63 and an outlet shaft 64 is variable in these proportions;

by using a constant velocity joint, such as a tripod joint, at one end of a sloping shaft, and by connecting it to a cardan joint, two parallel shafts 64, 65 can be linked and the outlet speed can be rendered nonlinear.

Figure 8C:
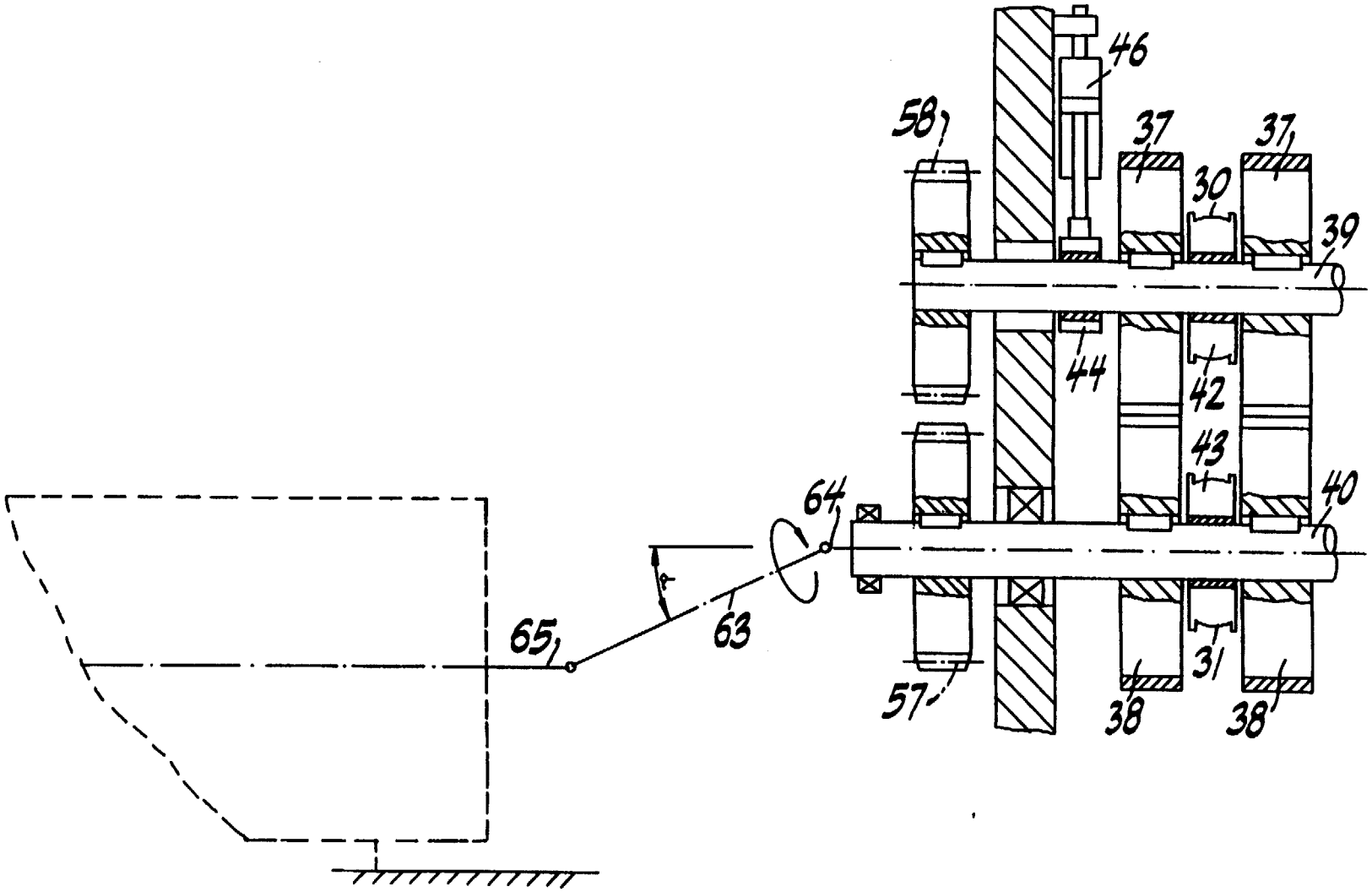

Such a cardan joint is shown in FIG. 8*c*. Other systems for speed delinearization could also be used for this application, such as systems with two cranks linked by a rod, etc.

In the operation of the system a signature 27' is transported between the partial pulleys 37 and 38 by set of fast belts 28 and 29, at the speed of the fast belts (line 72 in FIG. 9). When this signature 27' protrudes a few centimeters past the center lines of shafts 39 and 40, the partial pulleys 37 and 38 arrive at the point in their rotation where they are covered in rubber, as shown in FIG. 6. The various components are adjusted so that this point is the point of maximum speed of these pulleys. The signature 27' then takes the speed of the partial pulleys, i.e., that of the fast belts (line 72). As they rotate, the partial pulleys 37 and 38 and the signature 27', which is gripped between them, pass from speed 72 to speed 73 (via the solid-line portion of curve 71 in FIG. 9). During this rotation, the leading edge of the signature is inserted between the belts 30 and 31 which are moving at precisely the same speed (line 73). Once the rubber-covered parts of the partial pulleys 37 and 38 have then gone past, the signature is carried away by the slow belts 30 and 31. The signature is thus temporarily supported between the set of fast belts and the partial pulleys and then again between the partial pulleys and the set of slow belts.

The adjusting wheels 35 and 35' on the fast and slow belts, as shown in FIG. 6, serve to adjust the precise point at which the belts grip together as the signature is released and taken up by the belts. The hinge of lever 44 which is loaded by the actuator 46 of the upper partial pulleys 37, controls the force with which the pulleys grip a signature regardless of how thick it may be, and also allows the force to be released if a blockage occurs due to signatures piling up between the two partial pulleys.

Figure 10:
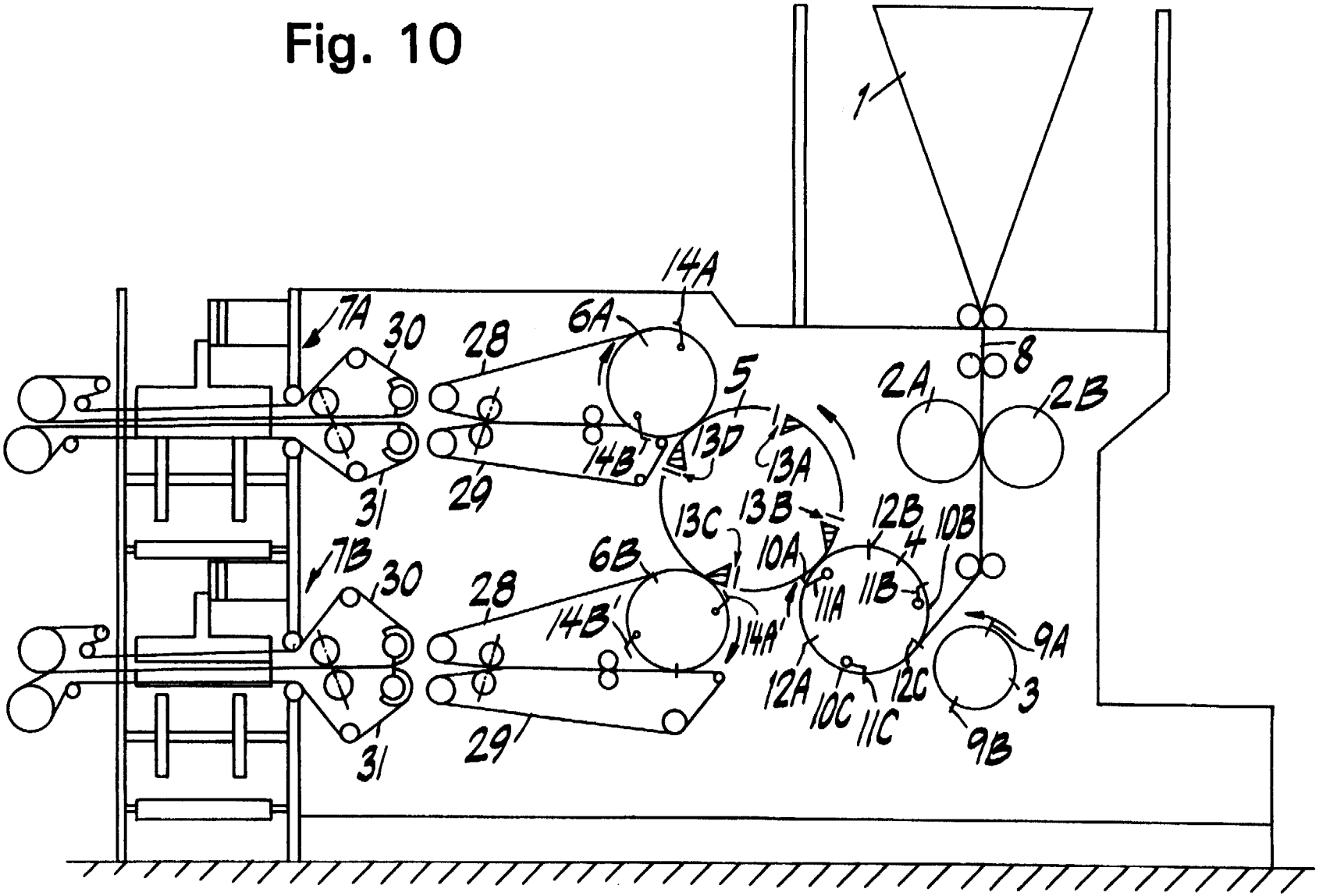
FIG. 10 is a side plan view of a folder with slow-down cylinders embodying the present invention.
Figure 11:
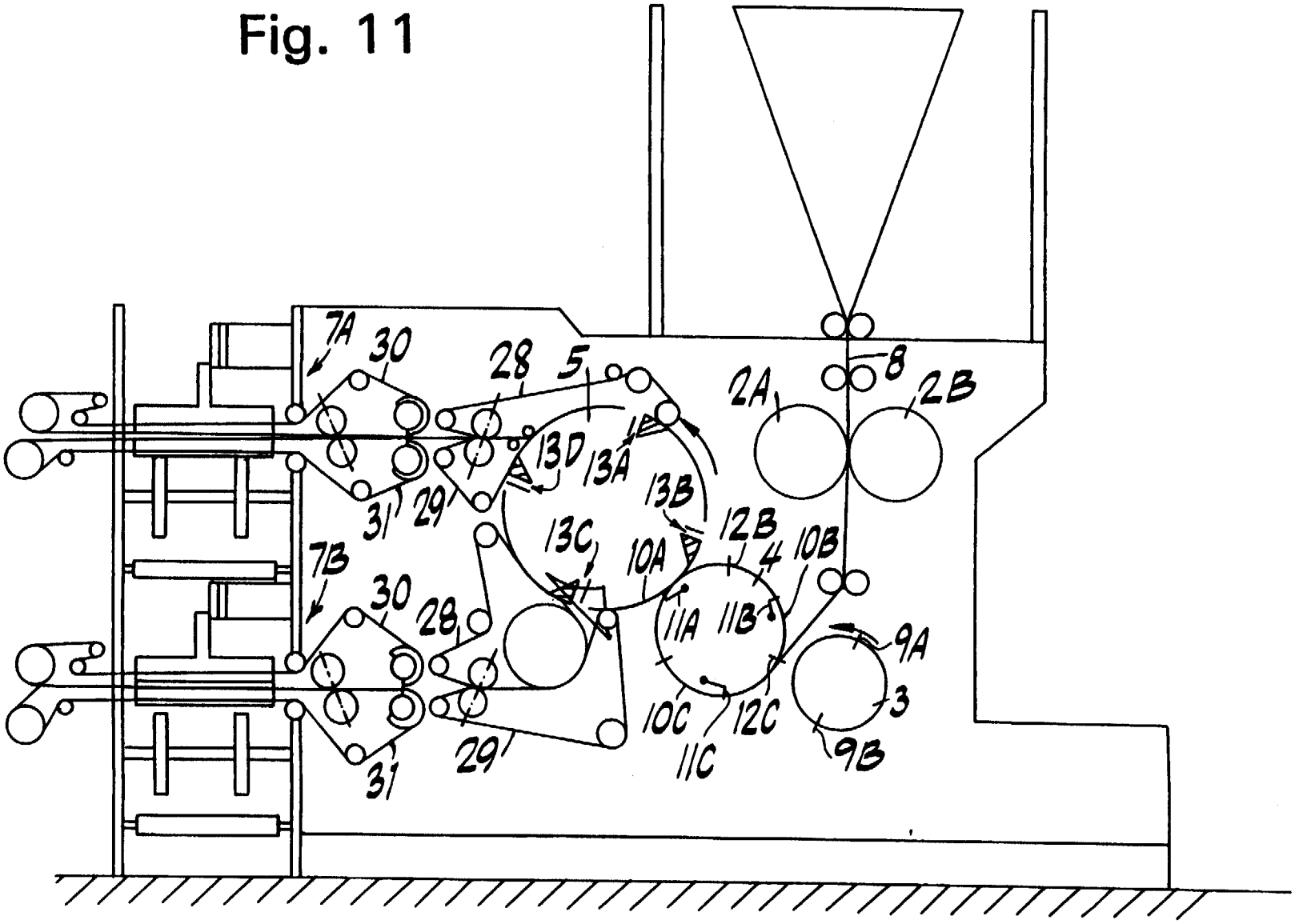
FIG. 11 is a side plan view of a folder without slow-down cylinders embodying the present invention.

A folder embodying the present invention provided with two separate sets of belts following two slow-down cylinders, one for the upper quarter fold and one for the lower quarter fold is shown in FIG. 10. A folder of this type can also be designed without slow-down cylinders at the top or the bottom, as shown in FIG. 11. In this case the sets of fast belts take the signature directly from the folding cylinder 5. The eccentricity between the shafts 40 and 48, as well as the radius of rotation of the axle of the cam wheel 54 around the shaft 48 are adjusted, in this case to obtain a cyclic reduction of the speed of the partial pulleys equal to one-half. In addition, the slow belts turn at half the speed of the fast belts.

The present invention is in no way intended to be limited to the uses discussed above. It could also be used to slow down signatures in a variable-cutting folder such as those used in photoengraving, for example, or in any other type of folder. Furthermore, the invention could also be operated in reverse, i.e., to speed up or accelerate signatures. This is accomplished simply by setting the speed of the partial pulleys so that they grip the signatures at the slow end of their cycle, which is adjusted to correspond to the speed of the signatures being released from the first transport means, and then release the signatures at the fast end of their cycle. The second transport means is also adjusted so that it operates at the same (higher) speed of the signatures when they are released from the partial pulleys. In this case, the first transport means is preferably a set of slow belts including upper and lower belts and the second transport means is preferably a set of fast belts including upper and lower belts.

We claim:

1. An apparatus for changing the speed of signatures being transported in a folder machine comprising:

a first transport means for transporting a signature;

an assembly of upper and lower pulleys, each of the upper and lower pulleys having a raised portion on its circumferential surface, the assembly of upper and lower pulleys being mounted to a frame adapted to receive the signature by its leading edge from the first transport means at a first speed;

means for driving the assembly of upper and lower pulleys so as to change the speed of the signature from the first speed to a second speed;

a second transport means adapted to receive the signature by its leading edge from the assembly of upper and lower pulleys at the second speed; and means for adjusting the positions at which the first and second transport means release and receive the signature.

2. An apparatus for changing the speed of signatures being transported in a folder machine comprising:

a first transport means for transporting a signature;

an assembly of upper and lower pulleys, each of the upper and lower pulleys having a raised portion on its circumferential surface, the assembly of upper and lower pulleys being mounted to a frame adapted to receive the signature by its leading edge from the first transport means at a first speed;

means for driving the assembly of upper and lower pulleys so as to change the speed of the signature from the first speed to a second speed;

a second transport means adapted to receive the signature by its leading edge from the assembly of upper and lower pulleys at the second speed;

wherein the driving means cyclically varies the speed of rotation of the assembly of upper and lower pulleys between the first speed and the second speed; and wherein the driving means comprises two parallel shafts, an inlet shaft moving with uniform rotation, and an outlet shaft moving at a variable speed, each of the two shafts including a flange on its end facing the other shaft.

3. An apparatus for changing the speed of signatures being transported in a folder machine comprising:

a first transport means for transporting a signature;

an assembly of upper and lower pulleys, each of the upper and lower pulleys having a raised portion on its circumferential surface, the assembly of upper and lower pulleys being mounted to a frame adapted to receive the signature by its leading edge from the first transport means at a first speed;

means for driving the assembly of upper and lower pulleys so as to change the speed of the signature from the first speed to a second speed;

a second transport means adapted to receive the signature by its leading edge from the assembly of upper and lower pulleys at the second speed;

wherein the driving means cyclically varies the speed of rotation of the assembly of upper and lower pulleys between the first speed and the second speed; and wherein the driving means comprises two parallel shafts linked by an obliquely oriented shaft including a cardan joint on one end and a constant-velocity joint on the other.

4. An apparatus for changing the speed of signatures being transported in a folder machine comprising:

a first transport means for transporting a signature at a first speed;

a second transport means for transporting the signature at a second speed;

an assembly of upper and lower pulleys, each of the upper and lower pulleys having a raised portion on its circumferential surface, the assembly of upper and lower pulleys being mounted to a frame adapted to receive the signature by its leading edge from the first transport means at the first speed;

means for driving the assembly of upper and lower pulleys so as to change the speed of the signature from the first speed to the second speed;

means for adjusting the positions at which the first and second transport means release and receive the signature; and wherein the driving means cyclically varies the speed of rotation of the assembly of the upper and lower pulleys between the first speed and the second speed.

5. The apparatus according to claim 4, wherein the position adjusting means comprises a roller mounted to oscillate at the end of a lever whose longitudinal position is adjusted by an adjusting wheel acting on a nut and bolt system.

6. The apparatus according to claim 5, wherein the driving means comprises two parallel shafts, an inlet shaft moving with uniform rotation, and an outlet shaft moving at a variable speed, each of the two shafts including a flange on its end facing the other shaft.

7. An apparatus for changing the speed of signatures being transported in a folder machine comprising:

a first transport means for transporting a signature at a first speed;

a second transport means for transporting the signature at a second speed;

an assembly of upper and lower pulleys, each of the upper and lower pulleys having a raised portion on its circumferential surface and each pulley being mounted on a separate shaft, the assembly being mounted on a frame adapted to receive the signature by its leading edge from the first transport means at the first speed;

means for driving the assembly of upper and lower pulleys so as to change the speed of the signature from the first speed to the second speed;

means for maintaining the shafts of the upper and lower pulleys in fixed positions and at constant distances apart from each other; and wherein the means for maintaining the shafts of the upper and lower pulleys in fixed positions and at constant distances apart from each other comprises two levers on which the shaft of the upper pulley is mounted, the two levers being hinged to the frame about an axis, and a pneumatic actuator urging at least one of the two levers against an adjustable stop fixed to the frame.

* * * * *